US005454887A

United States Patent [19]

Fukui

[11] Patent Number: 5,454,887

[45] Date of Patent: Oct. 3, 1995

[54] PROCESS FOR MANUFACTURING A MEDIUM-CARBON STEEL PLATE WITH IMPROVED FORMABILITY AND WELDABILITY

[75] Inventor: Kiyoshi Fukui, Nishinomiya, Japan

[73] Assignee: Sumitomo Metal Industries, Ltd., Osaka, Japan

[21] Appl. No.: 95,340

[22] Filed: Jul. 23, 1993

[30] Foreign Application Priority Data

Sep. 29, 1992 [JP] Japan ..... 4-259894

[51] Int. Cl.[6] ..... C22C 38/32

[52] U.S. Cl. ..... 148/603; 148/601

[58] Field of Search ..... 148/601, 603

[56] References Cited

U.S. PATENT DOCUMENTS

| | | | |
|---|---|---|---|
| 5,108,518 | 4/1992 | Fukui et al. | 148/603 |
| 5,139,583 | 8/1992 | Kawabata et al. | 148/653 |
| 5,156,691 | 10/1992 | Hollenberg et al. | 148/663 |

FOREIGN PATENT DOCUMENTS

| | | | |
|---|---|---|---|
| 60-52551 | 3/1985 | Japan . | |
| 63-317629 | 12/1988 | Japan . | |
| 64-25946 | 1/1989 | Japan . | |
| 2-101122 | 4/1990 | Japan . | |
| 4-124216 | 4/1992 | Japan | 148/601 |

*Primary Examiner*—Stanley S. Silverman
*Assistant Examiner*—Sikyin Ip
*Attorney, Agent, or Firm*—Burns, Doane, Swecker & Mathis

[57] ABSTRACT

A process for manufacturing a medium-carbon steel plate having a graphitization of 50% or more with improved formability and weldability is disclosed, the process comprises the steps of:

hot rolling a steel with a finishing temperature of 700°–900° C., the alloy composition of the steel consisting essentially of, by weight %:

C: 0.20–0.70%,

Si: more than 0.20 but not more than 2.00%,

Mn: 0.05–0.50%, P: not more than 0.020%,

S: not more than 0.010%, sol. Al: 0.01–1.00%,

B: 0.0003–0.0050%, N: 0.002–0.010%,

B/N: 0.2–0.8,

Cu: 0–1.00%, Ni: 0–2.00%, Ca: 0–0.010%, and

Fe and incidental impurities: balance, cooling the resulting hot-rolled steel plate at a cooling rate of 5°–50° C./s, coiling the steel plate at a temperature of 400°–650° C., and optionally, cold rolling the hot-rolled steel plate with a reduction in thickness of 20–85%, and annealing the cold-rolled steel plate at a temperature of 600°- $Ac_1$ for 1 hour or longer.

12 Claims, 2 Drawing Sheets

PROCESS FOR MANUFACTURING A MEDIUM-CARBON STEEL PLATE WITH IMPROVED FORMABILITY AND WELDABILITY

This invention relates to a process for manufacturing a medium-carbon steel plate with improved formability and weldability. More particularly, it relates to a process for manufacturing a wear-resistant, medium-carbon steel plate which has substantially the same mechanical properties as mild steel and exhibits a high strength and hardness after heat treatment of formed articles.

Usually, a high-carbon steel is used as a thin steel plate in the manufacture of vehicle parts such as automotive parts, which are required to have a high hardness and wear resistance. For this purpose, spheroidizing of cementite is performed on a hot-rolled or cold-rolled steel plate so as to soften the steel plate to such a level that the following cold rolling, if any in the case of hot-rolled steel plate, or the forming of the plate can be done easily. After formation, a heat treatment is performed so as to ensure a predetermined level of strength and hardness.

Conventional spheroidizing annealing has been carried out by way of a box annealing process. In the case of high-carbon steel plates, however, a steel plate after spheroidizing annealing still has a relatively high strength, and improvements in cold rolling workability and formability are not satisfactory. Occurrence of cracking is inevitable when a reduction in thickness during cold rolling is increased to some extent. Thus, it is necessary to perform intermediate annealing during cold rolling, resulting in an inevitable increase in the number of rolling passes as well as additional steps of processing. Furthermore, even if cold rolling+ annealing are repeated several times, the strength of high-carbon steel is generally as high as in the range of 400–800 N/mm$^2$, formability is not satisfactory, and weldability is degraded because of a high content of carbon.

In order to avoid such disadvantages with high-carbon steel, it has been proposed to graphitize cementite which is present as a second phase in a high-carbon steel so that the volume ratio of cementite is decreased and hardness thereof is also reduced. See Japanese Unexamined Laid-Open Patent Applications Nos. 60-52551/1985, 63-317629/1988, 64-25946/1989, and 2-101122/1990.

The processes disclosed in the first two publications essentially require cold rolling followed by box annealing. The use of box annealing inevitably adds to manufacturing costs. In addition, the steel plates manufactured by the processes disclosed in the other two publications suffer from degradation in weldability because of a high content of carbon. A marked deterioration in toughness of weld zone is inevitable during welding which is essential for assembling vehicle parts such as automobile parts formed of steel to automobile bodies. Furthermore, the formation of quenching cracks caused by the occurrence of transformation stresses is inevitable during transformation into martensite.

SUMMARY OF THE INVENTION

An object of this invention is to provide a process for manufacturing in a less expensive manner a medium-carbon steel plate which is soft, i.e., having a tensile strength of 550 N/mm$^2$ or less and an elongation of 25% or more before formation exhibiting improved formability, which has a high tensile strength and hardness as well as improved wear resistance after heat treatment following the formation, and which also exhibits improved weldability due to a reduction in the carbon content.

The inventor of this invention made the following discoveries, on the basis of which this invention was completed.

i) According to the results of experiments carried out by the inventor it is advisable that the content of carbon be reduced to not more than 0.70% in order to promote graphitization to ensure a satisfactory level of softness and elongation. Preferably, in order to further improve weldability of steel plate the content of carbon is restricted to 0.40% or less, so that the occurrence of quenching cracks can be suppressed during spot welding and arc welding, which are widely used in assembly lines of automobile. On the other hand, the lower limit of carbon is defined as 0.20% so as to obtain a metallurgical structure in which 50% or more of the cementite is graphitized by annealing after hot rolling.

However, when the carbon content is reduced, a marked reduction in strength and hardness is inevitable for final products due to a degraded hardenability. In this invention, incorporation of B in a steel composition is effective to promote precipitation or refine graphite and ensure improvement in strength as well as hardness of final products. For these purposes B in an amount of 0.0003–0.0050% is added to the steel composition in this invention.

ii) The presence of Si and sol. Al each in a relatively large amount is effective to promote graphitization of cementite. On the other hand, the presence of Si and sol. Al causes solid solution hardening. Thus, in order to suppress an excessive increase in TS during graphitizing annealing the upper limit each of Si and sol. Al is restricted to 2.00% or less and 1.00% or less, respectively.

The upper limit of the Mn content is restricted to 0.50% in order to ensure formation of graphite, and the lower limit thereof of 0.05% is introduced to ensure satisfactory level of toughness by suppressing formation of MnS.

The content of P and S, which are elements to prevent graphitization, is restricted to a low range. In particular, the P content is restricted to 0.020% or less and the S content is restricted to 0.010% or less for the present invention in which the carbon content is restricted to 0.70% or less.

The incorporation of Ca is effective for promoting graphitization and improving toughness after quenching, when it is added in an amount of 0.001% or more. Furthermore, it is also preferable to incorporate Cu in an amount of 0.05–1.00% and Ni in an amount of 0.05–2.00% in order to ensure hardenability without adversely affecting graphitization.

iii) Hot rolling conditions are determined such that a metallurgical structure comprising ferrite+graphite or ferrite+graphite+cementite can be obtained while the steel is kept hot after coiling.

iv) Cold rolling conditions, in the case of cold-rolled steel plate, are determined such that a texture having highly developed {111} orientations can be obtained with a value of r being 1.0 or larger.

v) Sometimes it was found that there was graphite precipitated on the surface of the steel plate which had been subjected to a final annealing treatment of changing cementite into graphite. The precipitated graphite is called "black stains".

When a steel plate having such black stains is formed into an automobile part and is installed in an automatic transmission, silicone oil which is used as transmission oil is contaminated by the graphite precipitated on the surface of the plate.

Annealing carried out in an atmosphere containing 80% or more of hydrogen is very effective for preventing precipitation of graphite on the surface of a steel plate, even for a steel containing 0.20–0.70% of carbon. In the past for a low-carbon steel plate it was reported that an annealing carried out in an atmosphere containing 40 vol. % or more of hydrogen was effective for preventing precipitation of graphite on the steel plate surface.

Thus, this invention is a process for manufacturing a medium-carbon steel plate having a graphitization of 50% or more with improved formability and weldability.

The steel composition of this invention consists essentially of, by weight %:

C: 0.20–0.70%, Mn: 0.05–0.50%,

Si: more than 0.20 but not more than 2.00%,

P: not more than 0.020%, S: not more than 0.010%, sol. Al: 0.01–1.00%, B: 0.0003%–0.0050%,

N: 0.002–0.010%, B/N: 0.2–0.8

Cu: 0–1.00%, Ni: 0–2.00%, Ca: 0–0.010%, and

Fe and incidental impurities: balance.

The steel composition may comprise at least one element selected from the group consisting of:

Cu: 0.05–1.00%, Ni: 0.05–2.00%, and Ca: 0.001–0.010%.

In a preferred embodiment, the carbon content is restricted to 0.20–0.40%. The Si content may be restricted to more than 0.20% but not more than 1.00%. A preferred content of sol. Al is 0.05–1.00%.

The process of this invention comprises the steps of:

hot rolling a steel having an alloy composition described above with a finishing temperature of 700°–900° C., cooling the resulting hot-rolled steel plate at a cooling rate of 5°–50° C./s, coiling the steel plate at a temperature of 400°–650° C., and annealing the steel plate at a temperature of 600°- $Ac_1$ for 6 hours or longer.

In a preferred embodiment, the annealing temperature is 670°–740° C., and in another embodiment at least the annealing is carried out in an atmosphere containing 80% or more of hydrogen.

In another aspect, this invention is a process for manufacturing a medium-carbon steel plate having a graphitization of 50% or more with improved formability and weldability, which comprises the steps of:

hot rolling a steel having the above-described alloy composition with a finishing temperature of 700°–900° C., cooling the resulting hot-rolled steel plate at a cooling rate of 5°–50° C./s, coiling the steel plate at a temperature of 400°–650° C., cold rolling the hot-rolled steel plate with a reduction in thickness of 20–85%, and annealing the cold-rolled steel plate at a temperature of 600°- $Ac_1$ for 1 hour or longer.

In a preferred embodiment, before carrying out the cold rolling a preliminary annealing may be applied to the hot-rolled steel plate at a temperature of 600°- $Ac_1$ for 6 hours or longer, in another embodiment the annealing temperature is 670°–740° C.

DESCRIPTION OF THE PREFERRED EMBODIMENTS

Figure 1:
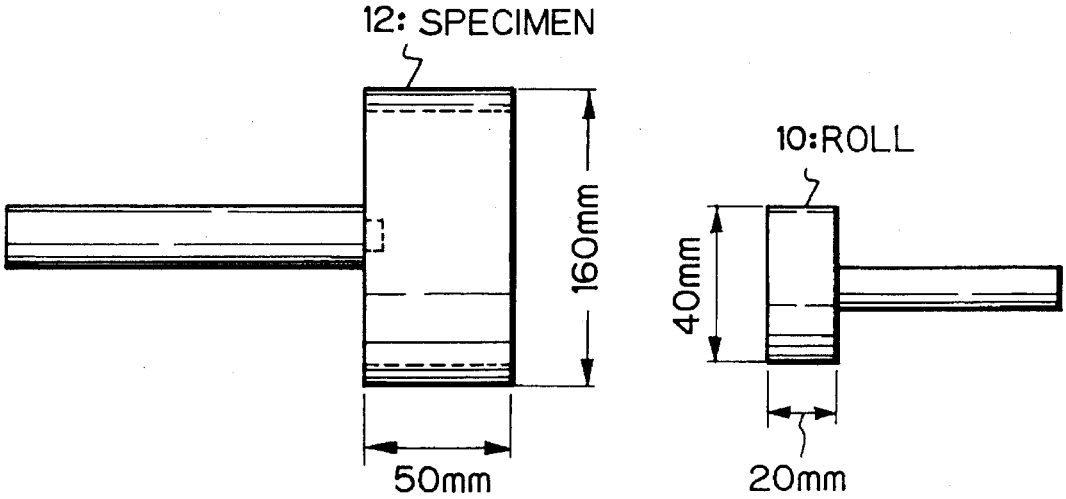
FIG. 1 is a diagrammatic side view of a specimen and a roll which are used in a rotating friction test to evaluate the amount of graphite precipitated on the surface of the plate.

The reasons for restricting the steel composition and manufacturing conditions of this invention as described above will now be explained in detail. In this specification, the unit "%" means "% by weight" for the steel composition, "% by volume" for the concentration of hydrogen, and "% by area" for the graphitization.

(Chemical Composition)

Carbon (C):

In general, the lower the carbon content the more the elongation and formability can be improved. However, in order to make sure that a predetermined level of hardness, wear resistance, and fatigue resistance can be achieved after final heat treatment, it is necessary to incorporate a certain amount of carbon. In addition, a medium-carbon steel plate manufactured in accordance with the process of the present invention is usually subjected to heat treatment such as quenching, tempering, and austempering after formation. Under usual conditions, a general target value after heat treatment is 980 $N/mm^2$ or more for tensile strength and is 300 Hv or higher for hardness.

Therefore, the carbon content is restricted to 0.20% or higher so as to achieve the above-described mechanical properties.

On the other hand, the upper limit is defined as 0.70% so as not to impair toughness and formability, i.e., so as to ensure a satisfactory level of softness, elongation, and r-value before quenching. Preferably, the upper limit is restricted to 0.40% so as to further improve toughness, especially that of weld zones, and to avoid cracking during welding and quenching.

Thus, according to this invention the carbon content is restricted to 0.20–0.70% and preferably to 0.20–0.40%.

Silicon (Si):

Silicon is effective for promoting graphitization of cementite. In order to achieve efficient graphitization, the silicon content is restricted to more than 0.20%. On the other hand, since the incorporation of Si in steel easily causes hardening of the steel, the upper limit is defined as 2.00% so as not to increase hardness excessively. Preferably, the Si content is restricted to not more than 1.00%.

Manganese (Mn):

Since manganese is effective for stabilizing cementite and the presence of manganese in steel suppresses decomposition of cementite during annealing and prevents precipitation of graphite markedly, the upper limit of the Mn content is restricted to 0.50%. On the other hand, manganese is effective for improving hardenability. Manganese also combines with S in steel to form MnS so that the resulting steel is free from an adverse effect of S and exhibits improved toughness. Thus, the Mn content is restricted to 0.05–0.50%.

Phosphorous (P):

Phosphorous segregates along the crystal boundaries between cementite and ferrite to suppress movement of carbon so that graphitization of cementite is markedly prevented. Especially, when the carbon content is as low as in this invention, the presence of P, even in a small amount, is harmful for graphitization. In order to shorten the time for carrying out box annealing, the smaller the P content the better. Thus, the P content is restricted to 0.020% or less and preferably to 0.015% or less. Within this range, the smaller the amount the better.

Sulfur (S):

Sulfur (S) also adversely affects graphitization. The larger the S content the longer the time for achieving graphitization during box annealing. In addition, since S dissolved in steel remarkably deteriorates toughness of a steel plate, the strength of which has been improved by heat treatment, it is necessary to decrease the S content to as low as possible. Thus, according to this invention the S content is restricted to 0.010% or less.

sol. Al:

Since the presence of Al in steel promotes graphitization of cementite, the content of sol. Al is restricted to 0.01% or more and preferably 0.05% or more in this invention. It is desirable to incorporate a relatively large amount of sol. Al so as to promote graphitization of cementite. However, an excess amount of Al usually results in solution hardening of ferrite and increases the amount of oxide precipitates in steel to deteriorate toughness of final products after heat treatment. Thus, in this invention the upper limit of sol. Al is defined as 1.00%.

Boron (B):

Boron is effective for improving toughness after heat treatment as well as hardenability. Since in this invention the carbon content is restricted to 0.20–0.70%, the presence of B in an amount of at least 0.0003% (3 ppm) is necessary in order to ensure a predetermined level of strength after heat treatment. On the other hand, when the B content is over 0.0050% (50 ppm), formation of intermetallic inclusions such as FeB, $Fe_2B$, and $Fe_{23}(CB)$ is inevitable during hot rolling or the subsequent heat treatment, resulting in an adverse effect on toughness. The B content, therefore, is restricted to 0.0003–0.0050%.

Nitrogen (N):

Nitrogen is usually an incidental impurity of steel. However, in this invention, nitrogen forms nitrogen compounds such as aluminum nitrides (AlN, for example) during heat treatment including quenching, tempering, and austempering, suppressing coarsening of austenite grains. Thus, it is desirable that a given amount of nitrogen be present in steel in order to eliminate dimensional distortions and improve toughness after heat treatment. In this invention, the lower limit of the N content is restricted to 0.002%. When the content of N is over 0.010%, ductility of steel is adversely affected, so the upper limit of N is restricted to 0.010% and preferably to 0.005%.

It has also been found that formation of BN can improve toughness of the steel plate manufactured by the process of this invention. For this purpose, the ratio of B/N is restricted to 0.2–0.8. When the ratio is less than 0.2, a sufficient amount of BN is not formed. On the other hand, when the ratio is over 0.8, formation of intermetallic inclusions such as FeB is inevitable.

In addition to the above-identified elements, other elements such as Cu, Ni, and Ca may be optionally incorporated in the steel.

Copper (Cu):

Cu is effective for improving hardenability without impairing graphitization. The presence of Cu has no substantial effect on solid-solution hardening. Cu is incorporated in steel as an optional element and the lower limit thereof is defined as 0.05%. On the other hand, when Cu in an amount of over 1.00% is added, precipitation of ε-Cu is inevitable during cooling after box-annealing, resulting in an increase in strength and a degradation in formability. Thus, the upper limit of Cu is defined as 1.00%.

Nickel (Ni):

Ni, like Si, is effective for promoting graphitization of cementite, but Ni is less effective than Si in respect to solid-solution hardening. Namely, Ni is effective for promoting softening of the resulting steel while promoting graphitization. For this purpose, Ni in an amount of 0.05% or more is added to steel, but when an excess amount of Ni is added, solid-solution hardening of ferrite and an increase in material costs are inevitable. Thus, the upper limit of Ni is defined as 2.00%.

Calcium (Ca):

Ca is effective for promoting graphitization of cementite during annealing. Ca is also effective for reducing the amount of oxygen dissolved in steel and the amount of aluminum oxides. As mentioned before, it is desirable that the amount of sol. Al be increased so as to further promote graphitization. Thus, the addition of Ca is carried out in order to prevent sol. Al from being lost in the form of oxides.

Furthermore, Ca also has the effect of fixing sulfur which has an adverse effect on graphitization and which degrades mechanical properties. Thus, the presence of Ca can reduce the necessary amount of Mn to fix sulfur, Mn being effective for fixing sulfur but adversely affecting graphitization.

For these purposes at least 0.001% of Ca is necessary. On the other hand, when an excess amount of Ca is added to steel, an increase in material and processing costs is inevitable, and the amounts of Ca-oxides and -sulfides in steel are inevitably increased, resulting in degradation in mechanical properties. Thus, the Ca content, if added, is restricted to 0.010% or less.

The medium-carbon steel plate having the above-mentioned steel composition is processed through a series of heat treatment steps.

(Metallurgical Structure)

A hot-rolled steel plate manufactured in accordance with the present invention comprises a metallurgically combined structure of ferrite+graphite or ferrite+cementite+ graphite. In general, the as-hot-rolled structure of a high-carbon steel plate is a ferrite+pearlite structure exhibiting a high strength and low elongation with a markedly degraded formability. Usually, even a hot-rolled steel plate is subjected to box annealing at a temperature to provide an α phase or α+γ dual phase so as to soften the steel by changing pearlite into spheroidized cementite. However, for steel plates with a medium-carbon content the tensile strength after being subjected to such an annealing treatment is on the order of 400–500 $N/mm^2$ with an elongation of 40% or less. Formability is still poor. Thus, according to this invention, a steel composition is adjusted as described above and cementite is subjected to graphitization so that the metallurgical structure of the steel plate can comprise the above-defined combined phases. In a preferred embodiment, the graphitization ratio of steel plates of this invention is 50% for 0.2% C-steel plates and 75% for 0.4% C-steel plates, each steel plate exhibiting the same level of strength as 0.1% C mild steel plates.

(Processing Steps)

Hot rolling:

It is preferable that a steel plate be heated to a temperature of 1100° C. or higher for one hour or more before hot rolling so as to obtain a uniform pearlite structure after hot rolling.

The hot rolling finishing temperature has an influence on the size of pearlite grains after cooling, and a lower finishing temperature results in finer grains of pearlite. The finer the pearlite grains the finer the graphite precipitates in a final product steel. However, if the hot rolling finishing temperature is excessively low, the deformation resistance of the steel plate increases so much that the target thickness of the steel plate after rolling is relatively large due to a capacity limit of the rolling mill. Thus, the lower limit of the finishing temperature is 700° C. On the other hand, it is desirable that the upper limit thereof be defined as 900° C. in order to ensure a fine structure of the pearlite. Cooling rate after hot rolling and coiling temperature:

Cooling conditions after hot rolling, i.e., the cooling rate are important. It is desirable that the graphite structure be fine in order to improve hardenability of a final product. For this purpose the cooling rate after hot rolling is increased to refine the grain size of the resulting pearlite structure. In order to precipitate a fine size of graphite it is also desirable to adjust the lamellar distance of a pearlite structure to be 0.1 micrometer or less.

In order to achieve such a refined structure, the hot-rolled steel plate is cooled to a coiling temperature at a rate of 5° C./sec or higher. The higher the cooling rate the more refined is the structure that can be obtained. However, an excessively high cooling rate increases the hardness of the hot-rolled steel plate, sometimes resulting in breakage of the plate when it is bent during pickling, for example. Thus, in this invention, the cooling rate is restricted to 50° C./sec or less.

When the coiling temperature is high, transformation occurs after coiling and very coarse cementite is formed. Accordingly, the coiling temperature is lowered beyond a certain level so as to obtain a refined grain size of graphite after annealing of hot-rolled steel plate. Based on test results obtained by a series of experiments it is noted that when the coiling temperature is 650° C. or less, the resulting pearlite structure is a refined stable one, and it is possible to shorten the time required to perform annealing in the next step. When the coiling temperature is over 650° C., the grain size of the resulting pearlite is coarsened, and the graphite after annealing is also coarsened. On the other hand, when the coiling temperature is lower than 400° C., the toughness of a hot-rolled steel plate is degraded, resulting in breakage of the plate when it is bent during pickling, for example.

Annealing of Hot-Rolled Plate:

In order to decompose cementite in steel and precipitate graphite in the course of annealing steps, it is necessary to heat the hot-rolled steel plate to 600° C. or higher. When the soaking temperature is over the $Ac_1$ point, the pearlite is decomposed to form a uniform austenitic structure. Thus, the upper limit of the annealing temperature is the $Ac_1$ point.

The minimum soaking time during which graphite can be precipitated is about 1 hour. However, a substantial amount of cementite remains unchanged in such a short period of time, and the formability of the steel plate is not satisfactory. In order to improve the formability, the soaking time is defined as 6 hours or longer in this invention. A preferable soaking time is 12 hours or longer. Since the longer the soaking time the lower the productivity, it is advisable to restrict the soaking time to 48 hours at longest.

Cold Rolling and Annealing:

The annealed texture of a hot-rolled steel plate is oriented at random, and the r-value is about 0.6–0.8, which means poor deep-drawability. In order to increase the r-value, it is necessary to develop textures in the {111} orientation. This can be achieved by cold rolling with a reduction in thickness of not less than 20% followed by annealing. Preferably, the reduction in thickness through cold rolling is 50% or more. However, as the reduction increases, ear cracks caused by work hardening occur frequently. The upper limit of the reduction, therefore, is 85%.

Since the purpose of annealing to be carried out after cold rolling is to recover and recrystallize crystal grains of the ferrite which were subjected to cold rolling, a long soaking time such as that required for a hot-rolled plate is not necessary. One hour or a longer period of time is enough.

There is no upper limit on the length of the annealing, and when it is intended to change the cementite which remains unchanged even by annealing after hot rolling, it is advisable to carry out box annealing for a relatively long period of time. In view of productivity it is preferable to complete annealing within 24 hours.

In this invention the annealing temperature after cold rolling is defined as 600° C. or higher so as to promote recovery of crystal grains of a ferrite structure. However, when the temperature is higher than the $Ac_1$ point, graphitized carbon is dissolved in steel, and a pearlite structure is formed during cooling, resulting in an increase in hardness as well as degradation in formability. Furthermore, textures formed by cold rolling are oriented at random, resulting in a degradation in deep drawability. Thus, in this invention the annealing temperature is defined as from 600° C. to the $Ac_1$ point.

The above-described cold rolling and the following annealing may be performed one time each or repeated twice or more. When two or more cycles of cold rolling and annealing are carried out, it is possible to achieve an increase in graphitization as well as the desired r-value more easily compared to the case in which the cold rolling is performed in a single pass with the total reduction in thickness adjusted to be the same.

Graphitizing Annealing Atmosphere:

Graphitization is performed on a hot-rolled steel plate after pickling or a cold-rolled steel plate in this invention. According to a preferred embodiment of this invention, the graphitizing annealing is performed in a hydrogen-containing atmosphere so as to successfully suppress precipitation of graphite on the surface of the steel plate. Graphite precipitation during graphitizing annealing also depends on the carbon content. When the graphitizing annealing is carried out in an atmosphere containing 80% by volume or more of hydrogen, there is no precipitation of graphite on the surface of a steel plate having a carbon content within the range of 0.20–0.70%.

During annealing the carbon diffusing from cementite in steel changes into graphite, which is more stable than cementite. However, since the change into graphite is followed by expansion in volume, there is a marked precipitation of graphite on the surface of the steel plate. This is because there is substantially no force to prohibit an expansion of graphite on the surface area of the plate. It is expected that a large number of graphite stains are formed on the surface of a steel plate containing a relatively large amount of carbon and that it is quite difficult to thoroughly remove the precipitated graphite.

In fact, it is impossible to remove the precipitated graphite stains by heating the plate in a combined gas atmosphere of nitrogen with an inert gas or coke-oven gas. However, in this invention, the graphitizing annealing is performed in an atmosphere containing 80% by volume of hydrogen. Thus, according to this invention the carbon which just precipitates on the surface of a steel plate as graphite reacts with hydrogen contained in the atmosphere to form methane ($CH_2$), leaving a clean surface free from graphite stains.

This invention will be described in conjunction with working examples which are presented merely for illustrative purposes and which are not in any way restrictive of the scope of this invention.

EXAMPLE 1

This example was performed so as to determine an influence of the content of each of Si, Mn, and B on mechanical properties and graphitization.

The steel compositions employed in this example are shown in Table 1, and the manufacturing conditions of this example were as shown below.

i) Hot rolling:

Heating before hot rolling: 1200° C.×1 hour

Finishing Temperature: 870° C.

Finishing Thickness: 2.0 mm (starting slab thickness of 220 mm)

ii) Cooling and coiling after hot rolling:

Hot-rolled plates were cooled at a rate of 25° C./sec to 550° C. and coiled.

ill) Annealing of hot-rolled steel plate:

Hot-rolled steel plates were annealed at 710° C. for 24 hours.

Mechanical properties and graphitization of the resulting hot-rolled steel plates were determined as shown in Table 2. Mechanical properties for the steel plates which were further heated to 950° C. for 30 seconds by induction heating, oil-quenched, and tempered at 200° C. for 45 minutes are also shown in Table 2.

The tensile specimens used in this example were JIS No.5 test pieces (thickness: 2.0 mm) and the impact specimens were JIS No.3 test pieces (10 mm×10 mm square section).

The graphitization can be defined by the following equation:

$$\text{Graphitization (\%)}=[1-(A)/(B)]\times 100\ (\%) \quad (1)$$

wherein

A: area where cementite precipitated after annealing

B: area where cementite precipitated before annealing

When the graphitization is 100%, the structure comprises ferrite and graphite, and when the graphitization is less than 100%, the structure comprises ferrite, graphite, and cementite.

As is apparent from Table 2, as the Si content increased the graphitization increased with an increase in strength and a decrease in elongation due to the solid-solution hardening effect of Si.

On the other hand, as the Mn content increased the graphitization decreased with a decrease in elongation. In the case of a low content of Mn, toughness after heat treatment also decreased.

Boron is effective for improving graphitization, but when an excess amount of B was added, the presence of B adversely affected the graphitization with a degradation in formability. In contrast, when the content of B was smaller than that required in this invention, the graphitization did not occur thoroughly, resulting in an insufficient level of hardness and toughness after heat treatment.

TABLE 1

| Run | Chemical Composition (wt %, bal: Fe) | | | | | | | | | | $Ac_1$ | |
|---|---|---|---|---|---|---|---|---|---|---|---|---|
| No. | C | Si | Mn | P | S | sol.Al | Ni | B | Ca | N | (°C.) | Remarks |
| A1 | 0.34 | 0.05 | 0.13 | 0.011 | 0.004 | 0.17 | Tr | 0.0027 | 0.004 | 0.0025 | 723.0 | x |
| A2 | 0.32 | 0.26 | 0.15 | 0.009 | 0.003 | 0.19 | Tr | 0.0020 | 0.003 | 0.0031 | 728.9 | |
| A3 | 0.34 | 0.87 | 0.13 | 0.011 | 0.004 | 0.17 | Tr | 0.0027 | 0.004 | 0.0035 | 746.9 | |
| A4 | 0.33 | 2.16 | 0.14 | 0.010 | 0.003 | 0.18 | Tr | 0.0024 | 0.003 | 0.0042 | 784.3 | x |
| A5 | 0.34 | 0.31 | 0.02 | 0.011 | 0.004 | 0.17 | Tr | 0.0027 | 0.004 | 0.0038 | 731.8 | x |
| A6 | 0.32 | 0.33 | 0.13 | 0.009 | 0.003 | 0.19 | Tr | 0.0020 | 0.003 | 0.0039 | 731.2 | |
| A7 | 0.32 | 0.33 | 0.24 | 0.009 | 0.003 | 0.19 | Tr | 0.0020 | 0.003 | 0.0034 | 730.0 | |
| A8 | 0.31 | 0.34 | 0.46 | 0.008 | 0.002 | 0.20 | Tr | 0.0017 | 0.002 | 0.0034 | 727.9 | |
| A9 | 0.33 | 0.32 | 0.78 | 0.010 | 0.003 | 0.18 | Tr | 0.0024 | 0.003 | 0.0038 | 723.9 | x |
| A10 | 0.30 | 0.35 | 0.17 | 0.007 | 0.002 | 0.21 | Tr | 0.0001 | 0.001 | 0.0041 | 731.3 | x |
| A11 | 0.32 | 0.33 | 0.15 | 0.009 | 0.003 | 0.19 | Tr | 0.0016 | 0.003 | 0.0040 | 730.9 | |
| A12 | 0.28 | 0.27 | 0.17 | 0.007 | 0.002 | 0.24 | Tr | 0.0089 | 0.001 | 0.0035 | 729.0 | x |

x: Outside the range of the Present Invention.

TABLE 2

| Run No. | YP ($N/mm^2$) | TS ($N/mm^2$) | El (%) | Graphitization (%) | Mechanical Properties after Heat Treatment YP ($N/mm^2$) | TS ($N/mm^2$) | Hardness (Hv) | vTrs (°C.) |
|---|---|---|---|---|---|---|---|---|
| A1 | 193.6 | 363.0 | 41.0 | 45 | 1418 | 1784 | 475 | 10 |
| A2 | 179.9 | 337.4 | 44.1 | 80 | 1347 | 1700 | 453 | 0 |
| A3 | 238.7 | 447.6 | 33.3 | 90 | 1418 | 1784 | 475 | −20 |
| A4 | 316.8 | 594.1 | 25.1 | 100 | 1524 | 1909 | 509 | −40 |
| A5 | 178.8 | 335.2 | 44.4 | 95 | 1418 | 1784 | 475 | 40 |

TABLE 2-continued

| Run No. | YP (N/mm²) | TS (N/mm²) | El (%) | Graphitization (%) | Mechanical Properties after Heat Treatment YP (N/mm²) | TS (N/mm²) | Hardness (Hv) | vTrs (°C.) |
|---|---|---|---|---|---|---|---|---|
| A6 | 203.3 | 381.1 | 39.1 | 75 | 1347 | 1700 | 453 | −20 |
| A7 | 256.8 | 481.5 | 31.0 | 60 | 1453 | 1826 | 487 | 10 |
| A8 | 285.4 | 535.2 | 27.9 | 55 | 1524 | 1909 | 509 | 0 |
| A9 | 318.1 | 596.4 | 25.0 | 50 | 1594 | 1992 | 521 | −40 |
| A10 | 192.9 | 361.7 | 41.2 | 80 | 1275 | 1614 | 430 | 20 |
| A11 | 181.1 | 339.5 | 43.8 | 85 | 1347 | 1700 | 453 | −40 |
| A12 | 185.7 | 335.5 | 44.4 | 95 | 1202 | 1528 | 406 | 80 |

EXAMPLE 2

In this example, the steel composition A2 shown in Table 1 was used to determine the influence of the cooling rate after hot rolling, annealing temperature (soaking temperature) of hot-rolled steel plates, and annealing time (soaking time) on mechanical properties and graphitization.

The manufacturing conditions of this example were as shown below. The coiling temperature was 520° C.

Heating before hot rolling: 1200° C.×1 hour

Finishing Temperature: 850° C.

Finishing Thickness: 3.0 mm (starting slab thickness of 220 mm)

Mechanical properties and graphitization of the resulting hot-rolled steel plates were determined as shown in Table 3. Mechanical properties for the steel plates were determined in the same manner as in Example 1.

As is apparent from Table 3, the higher and longer the cooling rate and annealing temperature and time, the more the graphitization increased with a decrease in strength and an increase in elongation.

On the other hand, when the annealing temperature was higher than that of this invention and the annealing time was shorter than that required, the graphitization of the resulting steel plate was relatively low and the strength was rather high.

EXAMPLE 3

This example was performed so as to determine the influence of the content of carbon on graphitization, mechanical properties, and weldability.

The steel compositions employed in this example are shown in Table 4, and the manufacturing conditions of this example were as shown below.

i) Hot rolling:

Heating before hot rolling: 1250° C.×1 hour

Finishing Temperature: 870° C.

Finishing Thickness: 5.0 mm (starting slab thickness of 220 mm)

ii) Cooling and coiling after hot rolling:

Hot-rolled plates were cooled at a rate of 20° C./sec to 550° C. and coiled.

iii) Annealing of hot-rolled steel plate:

Hot-rolled steel plates were annealed at 700° C. for 30 hours.

Mechanical properties before and after heat treatment and graphitization of the resulting hot-rolled steel plates were determined in the same manner as in Example 1.

Weldability was determined for the resulting hot-rolled steel plates (5.0 mm thick) after grinding to a thickness of 2.5 mm. Namely, the steel plate having a thickness of 2.5 mm was subjected to arc welding, and an impact specimen of JIS No. 3 test piece was cut from the welded plate with a U-notch being provided in the weld zone. The impact test was carried out at 0° C. to determine the toughness of the steel plate. The results are shown in Table 5.

As is apparent from Table 5, the steel plates containing up to 0.37% of carbon exhibited a high level of impact values. As the carbon content increased, the toughness of the weld zone decreased. Thus, it can be concluded that a preferred

TABLE 3

| Run No. | Cooling Rate (°C./sec) | Annealing Temp. (°C.) | Annealing Time (h) | YP (N/mm²) | TS (N/mm²) | El (%) | Graphitization (%) | Remarks |
|---|---|---|---|---|---|---|---|---|
| B1 | 2 | 710 | 36 | 286.8 | 450.6 | 33.3 | 45 | x |
| B2 | 10 | 715 | 36 | 220.5 | 395.1 | 38.0 | 65 | |
| B3 | 20 | 720 | 36 | 179.2 | 356.2 | 42.1 | 80 | |
| B4 | 40 | 685 | 36 | 150.5 | 326.5 | 45.9 | 95 | |
| B5 | 10 | 550 | 36 | 482.0 | 650.2 | 20.1 | 10 | x |
| B6 | 15 | 620 | 36 | 218.8 | 393.6 | 38.1 | 66 | |
| B7 | 15 | 680 | 36 | 203.2 | 379.3 | 39.5 | 71 | |
| B8 | 15 | 720 | 36 | 194.1 | 370.8 | 40.5 | 74 | |
| B9 | 30 | 760 | 36 | 251.0 | 427.0 | 30.9 | 30 | x |
| B10 | 20 | 710 | 0.5 | 573.5 | 637.2 | 23.5 | 25 | x |
| B11 | 10 | 680 | 4 | 409.6 | 538.6 | 27.9 | 35 | x |
| B12 | 10 | 700 | 16 | 239.0 | 411.3 | 36.5 | 60 | |
| B13 | 20 | 710 | 30 | 159.3 | 335.9 | 44.7 | 90 | |
| B14 | 25 | 715 | 72 | 143.4 | 318.6 | 47.1 | 100 | |

x: Outside the range of the Present Invention.

upper limit of carbon content is 0.40% from the viewpoint of improving toughness. On the other hand, when the carbon content was decreased to a level smaller than that required in this invention, the graphitization after annealing decreased so much that there was no substantial improvement in formability and the hardness after heat treatment was also lowered.

Hot-rolled steel plates were annealed under the conditions indicated in Table 7.

Mechanical properties, graphitizations, and impact values of the weld zones of the resulting hot-rolled steel plates were as shown in Table 7. The mechanical properties were as shown in Example 1 and the impact values were as shown in Example 3.

TABLE 4

| Run | Chemical Composition (wt %, bal: Fe) | | | | | | | | | | $Ac_1$ | |
|---|---|---|---|---|---|---|---|---|---|---|---|---|
| No. | C | Si | Mn | P | S | sol.Al | Ni | B | Ca | N | (°C.) | Remarks |
| C1 | 0.15 | 0.05 | 0.13 | 0.011 | 0.004 | 0.17 | Tr | 0.0027 | 0.004 | 0.0036 | 723.0 | x |
| C2 | 0.25 | 0.26 | 0.15 | 0.009 | 0.003 | 0.19 | Tr | 0.0020 | 0.003 | 0.0040 | 728.9 | |
| C3 | 0.37 | 0.87 | 0.13 | 0.011 | 0.004 | 0.17 | Tr | 0.0027 | 0.004 | 0.0034 | 746.9 | |
| C4 | 0.48 | 2.16 | 0.14 | 0.010 | 0.003 | 0.18 | Tr | 0.0024 | 0.003 | 0.0042 | 784.3 | x |

x: Outside the range of the Present Invention.

TABLE 5

| Run No. | YP ($N/mm^2$) | TS ($N/mm^2$) | El (%) | Graphitization (%) | Impact Value of Weld Zone (kgf-m), 0° C. | Mechanical Properties after Heat Treatment YP ($N/mm^2$) | TS ($N/mm^2$) | Hardness (Hv) | vTrs (°C.) | Remarks |
|---|---|---|---|---|---|---|---|---|---|---|
| C1 | 270.0 | 426.0 | 35.1 | 10 | 7.3 | 707 | 927 | 245 | −80 | x |
| C2 | 195.0 | 345.0 | 43.3 | 80 | 5.8 | 1092 | 1395 | 371 | −40 | |
| C3 | 179.0 | 349.2 | 42.8 | 90 | 4.2 | 1524 | 1909 | 509 | 10 | |
| C4 | 161.0 | 444.0 | 33.4 | 100 | 1.4 | 1901 | 2351 | 628 | 60 | x |

x: Outside the range of the Present Invention.

EXAMPLE 4

Hot-rolled steel plates having the steel compositions shown in Table 6, were manufactured under conditions indicated below.

i) Hot rolling:

Heating before hot rolling: 1200° C.×2 hour

Finishing Temperature: 870° C.

Finishing Thickness: 2.5 mm (starting slab thickness of 220 mm)

ii) Cooling and coiling after hot rolling:

Hot-rolled plates were cooled at the cooling rates indicated in Table 7 to 550° C. and coiled.

iii) Annealing of hot-rolled steel plate:

As shown in Table 7, according to this invention, steel plates having a high graphitization, a high strength, and improved formability could be obtained.

TABLE 6

| Run | Chemical Composition (wt %, bal: Fe) | | | | | | | | | | $Ac_1$ |
|---|---|---|---|---|---|---|---|---|---|---|---|
| No. | C | Si | Mn | P | S | sol.Al | Ni | B | Ca | N | (°C.) |
| D1 | 0.24 | 0.26 | 0.19 | 0.009 | 0.005 | 0.26 | Tr | 0.0024 | 0.004 | 0.0032 | 730.5 |
| D2 | 0.33 | 0.21 | 0.20 | 0.010 | 0.005 | 0.28 | Tr | 0.0028 | 0.005 | 0.0037 | 726.7 |
| D3 | 0.25 | 1.84 | 0.13 | 0.006 | 0.003 | 0.18 | Tr | 0.0008 | 0.004 | 0.0032 | 776.5 |
| D4 | 0.28 | 0.24 | 0.15 | 0.008 | 0.004 | 0.22 | Tr | 0.0016 | 0.003 | 0.0034 | 729.8 |
| D5 | 0.30 | 0.25 | 0.41 | 0.008 | 0.004 | 0.24 | Tr | 0.0020 | 0.004 | 0.0041 | 730.1 |
| D6 | 0.33 | 0.27 | 0.20 | 0.002 | 0.002 | 0.28 | Tr | 0.0028 | 0.003 | 0.0039 | 730.8 |
| D7 | 0.34 | 0.28 | 0.21 | 0.011 | 0.006 | 0.08 | Tr | 0.0032 | 0.002 | 0.0040 | 731.2 |
| D8 | 0.33 | 0.27 | 0.20 | 0.010 | 0.005 | 0.28 | 1.59 | 0.0028 | 0.001 | 0.0039 | 713.8 |
| D9 | 0.27 | 0.22 | 0.15 | 0.007 | 0.003 | 0.20 | 0.33 | 0.0012 | 0.001 | 0.0037 | 726.0 |
| D10 | 0.30 | 0.25 | 0.17 | 0.008 | 0.004 | 0.24 | 0.39 | 0.0020 | Tr | 0.0030 | 725.9 |
| D11 | 0.27 | 0.22 | 0.15 | 0.007 | 0.003 | 0.20 | 0.33 | 0.0012 | Tr | 0.0041 | 726.0 |

TABLE 7

| Run No. | Cooling Rate (°C./sec) | Annealing Temp. (°C.) | Annealing Time (h) | YP (N/mm²) | TS (N/mm²) | El (%) | Graphitization (%) | Impact Value of Weld Zone (kgf-m), 0° C. |
|---|---|---|---|---|---|---|---|---|
| D1 | 25 | 680 | 26 | 206.8 | 387.8 | 40.5 | 65 | 8.0 |
| D2 | 30 | 685 | 26 | 189.7 | 355.6 | 44.1 | 66 | 6.3 |
| D3 | 5 | 660 | 16 | 248.9 | 422.0 | 37.1 | 100 | 7.7 |
| D4 | 15 | 670 | 14 | 179.6 | 324.3 | 47.9 | 95 | 7.1 |
| D5 | 20 | 675 | 18 | 265.2 | 417.2 | 37.7 | 54 | 6.9 |
| D6 | 30 | 685 | 26 | 223.3 | 418.7 | 37.5 | 66 | 6.3 |
| D7 | 35 | 690 | 30 | 210.4 | 394.6 | 39.7 | 72 | 6.0 |
| D8 | 30 | 685 | 26 | 223.3 | 418.7 | 37.5 | 66 | 6.3 |
| D9 | 10 | 665 | 10 | 226.1 | 339.0 | 46.0 | 81 | 7.4 |
| D10 | 20 | 715 | 18 | 198.1 | 327.1 | 47.5 | 95 | 6.9 |
| D11 | 10 | 665 | 40 | 168.4 | 315.7 | 49.2 | 100 | 7.4 |

EXAMPLE 5

This example was performed so as to determine the influence of the content of each of Si, Mn, and B on mechanical properties and graphitization for cold-rolled steel plates.

The steel compositions employed in this example are shown in Table 8, and the manufacturing conditions of this example were as shown below.

i) Hot rolling:

Heating before hot rolling: 1250° C.×1 hour

Finishing Temperature: 860° C.

Finishing Thickness: 5.0 mm (starting slab thickness of 220 mm)

ii) Cooling and coiling after hot rolling:

Hot-rolled plates were cooled at a rate of 20° C./sec to 550° C. and coiled.

iii) Annealing of hot-rolled steel plate:

Hot-rolled steel plates were annealed at 710° C. for 24 hours.

iv) Cold rolling:

Cold rolling in a single pass was carried out with a reduction of 60%.

v) Annealing of cold-rolled steel plate:

Box annealing was carried out by heating at 700° C. for 16 hours.

Mechanical properties and graphitization of the resulting cold-rolled steel plates were determined in the same manner as in Example 1. Test results are shown in Table 9.

As is apparent from Table 9, as the Si content increased, the graphitization increased with an increase in strength and a decrease in elongation due to the solid-solution hardening effect of Si. When the Si content was over the upper limit defined in this invention, the tensile strength increased beyond 600 N/mm² and the elongation was lowered.

On the other hand, as the Mn content increased, the graphitization decreased with a decrease in elongation. In the case in which the Mn content was much larger than the upper limit thereof, the graphitization was zero.

Boron is effective for improving graphitization, but when an excess amount of B was added, the presence of B adversely affected the graphitization with a degradation in formability.

TABLE 8

| Run | Chemical Composition (wt %, bal: Fe) | | | | | | | | | | $Ac_1$ | |
|---|---|---|---|---|---|---|---|---|---|---|---|---|
| No. | C | Si | Mn | P | S | sol.Al | Ni | B | Ca | N | (°C.) | Remarks |
| A1 | 0.33 | 0.01 | 0.20 | 0.010 | 0.005 | 0.28 | Tr | 0.0028 | 0.004 | 0.0038 | 721.1 | x |
| A2 | 0.28 | 1.54 | 0.18 | 0.006 | 0.003 | 0.23 | Tr | 0.0019 | 0.004 | 0.0040 | 766.3 | |
| A3 | 0.37 | 2.38 | 0.24 | 0.013 | 0.007 | 0.34 | Tr | 0.0040 | 0.003 | 0.0042 | 789.6 | x |
| A4 | 0.28 | 0.24 | 0.16 | 0.008 | 0.004 | 0.22 | Tr | 0.0016 | 0.003 | 0.0039 | 728.1 | |
| A5 | 0.31 | 0.26 | 0.27 | 0.009 | 0.005 | 0.26 | Tr | 0.0024 | 0.003 | 0.0034 | 727.6 | |
| A6 | 0.27 | 0.22 | 0.46 | 0.007 | 0.003 | 0.20 | Tr | 0.0012 | 0.002 | 0.0035 | 724.5 | |
| A7 | 0.35 | 0.29 | 0.86 | 0.012 | 0.006 | 0.32 | Tr | 0.0026 | 0.003 | 0.0042 | 722.3 | x |
| A8 | 0.33 | 0.27 | 0.20 | 0.010 | 0.005 | 0.28 | Tr | 0.0002 | 0.001 | 0.0038 | 728.7 | x |
| A9 | 0.30 | 0.25 | 0.17 | 0.008 | 0.004 | 0.24 | Tr | 0.0016 | 0.003 | 0.0025 | 728.3 | |
| A10 | 0.34 | 0.28 | 0.21 | 0.011 | 0.006 | 0.30 | Tr | 0.0087 | 0.001 | 0.0034 | 728.9 | x |

x: Outside the range of the Present Invention.

TABLE 9

| Run No. | YP (N/mm²) | TS (N/mm²) | El (%) | Graphitization (%) | Remarks |
|---|---|---|---|---|---|
| A1 | 171.5 | 321.6 | 46.3 | 35 | x |
| A2 | 290.2 | 544.2 | 27.4 | 90 | |
| A3 | 339.1 | 635.8 | 23.5 | 100 | x |
| A4 | 181.1 | 339.6 | 43.8 | 75 | |
| A5 | 240.0 | 450.0 | 33.1 | 60 | |
| A6 | 247.4 | 463.8 | 32.2 | 55 | |
| A7 | 318.1 | 596.4 | 24.0 | 0 | x |
| A8 | 289.6 | 543.0 | 27.5 | 50 | x |
| A9 | 165.1 | 309.6 | 48.0 | 85 | |
| A10 | 294.2 | 521.0 | 26.5 | 40 | x |

x: Outside the range of the Present Invention.

EXAMPLE 6

In this example, a steel composition comprising 0.32% of C, 0.26% of Si, 0.20% of Mn, 0.010% of P, 0.003% of S, 0.15% of sol. Al, 0.0040% of N, 0.0020% of B (B/N=0.5), 0.003% of Ca, and a balance of Fe and incidental impurities ($Ac_1$ point: 729° C.) was used to determine the influence of the reduction of cold rolling and annealing temperature and time after cold rolling on mechanical properties and graphitization.

The manufacturing conditions of this example were as shown below.

i) Hot rolling:

Heating before hot rolling: 1200° C.×1 hour

Finishing Temperature: 860° C.

Finishing Thickness: 3.0 mm (starting slab thickness of 220 mm)

ii) Cooling and coiling after hot rolling:

Hot-rolled steel plates were cooled at a rate of 20° C./sec to 550° C. and coiled.

Annealing temperature of hot-rolled steel plates, reductions during cold rolling and annealing temperature and time after cold rolling were varied as indicated in Table 10. The cold rolling and annealing were not repeated.

Mechanical properties and graphitization of the resulting cold-rolled steel plates were as shown in Table 10. Mechanical properties for the steel plates were determined in the same manner as in Example 1.

As is apparent from Table 10, the higher the reduction during cold rolling, the larger the r-value. This was because textures in the {111} orientation markedly developed during cold rolling. In contrast, when the reduction was small, the r-value was very small, although the elongation was large.

On the other hand, so long as the annealing temperature fell in the range of 600° C. to $Ac_1$, the annealing temperature has no substantial effect on the mechanical properties. However, when the temperature was higher than the $Ac_1$ point, the r-value was lowered. In contrast, when the annealing temperature was lower than 600° C., strength increased too much and elongation decreased, although high r-values were achieved. Furthermore, the longer the box annealing time after cold rolling the higher were the elongation and r-value. However, when the annealing time was 0.5 hour, the elongation was small. Thus, according to this invention, the annealing (soaking) time is determined to be 1 hour or longer, and preferably 6 hours or longer.

EXAMPLE 7

This example was performed so as to determine the influence of the content of carbon on graphitization, mechanical properties, and weldability.

The steel compositions employed in this example are shown in Table 11, and the manufacturing conditions of this example were as shown below.

i) Hot rolling:

Heating before hot rolling: 1250° C.×1 hour

Finishing Temperature: 860° C.

Finishing Thickness: 5.0 mm (starting slab thickness of 220 mm)

ii) Cooling and coiling after hot rolling:

Hot-rolled plates were cooled at a rate of 20° C./sec to 550° C. and coiled.

iii) Annealing of hot-rolled steel plate:

Hot-rolled steel plates were annealed at 700° C. for 30 hours.

iv) Cold rolling:

Cold rolling in a single pass was carried out with a reduction of 60%.

v) Annealing of cold-rolled steel plate:

Box annealing was carried out by heating 680° C. for 20 hours.

Mechanical properties before and after heat treatment and graphitization of the resulting hot-rolled steel plates were determined in the same manner as in Example 1.

Furthermore, weldability was determined for the cold-rolled steel plates in substantially the same manner as illustrated in Example 3. Hardness was determined after heat treatment (870° C. ×20 minutes and oil-quenching). The results are shown in Table 12.

As is apparent from Table 12, the steel plates containing up to 0.38% of carbon exhibited a high level of impact values. As the carbon content increased, the toughness of weld zones decreased. Thus, it can be concluded that a preferred upper limit of the carbon content is 0.40% from the viewpoint of improving toughness. On the other hand, when the carbon content is decreased to a level smaller than that required in this invention, the graphitization after annealing decreased so much that there were no substantial improvement in formability and the hardness after heat treatment was also lowered.

TABLE 10

| Run No. | Cooling Rate (°C./sec) | Annealing Temp. (°C.) | Annealing Time (h) | Reduction in Thickness (%) | Annealing Temp. (°C.) | Annealing Time (h) | YP ($N/mm^2$) | TS ($N/mm^2$) | El (%) | r-Value | Graphitization (%) | Remarks |
|---|---|---|---|---|---|---|---|---|---|---|---|---|
| B1 | 20 | 710 | 24 | 20 | 670 | 16 | 197.7 | 334.6 | 44.8 | 1.16 | 91 | Present |
| B2 | 25 | 715 | 24 | 40 | 670 | 16 | 195.3 | 332.6 | 45.1 | 1.35 | 92 | Invention |
| B3 | 30 | 720 | 24 | 60 | 670 | 16 | 193.4 | 331.0 | 45.3 | 1.49 | 93 | |
| B4 | 15 | 685 | 24 | 80 | 670 | 16 | 201.3 | 337.6 | 44.4 | 1.50 | 89 | |
| B5 | 30 | 725 | 24 | 50 | 600 | 16 | 193.3 | 330.9 | 45.3 | 1.43 | 93 | |
| B6 | 10 | 700 | 24 | 50 | 630 | 16 | 204.9 | 340.7 | 44.0 | 1.34 | 87 | |
| B7 | 15 | 695 | 24 | 50 | 660 | 16 | 201.0 | 337.4 | 44.5 | 1.37 | 89 | |
| B8 | 15 | 705 | 24 | 50 | 680 | 16 | 200.7 | 337.1 | 44.5 | 1.37 | 89 | |
| B9 | 15 | 690 | 24 | 50 | 700 | 16 | 201.1 | 337.5 | 44.4 | 1.37 | 89 | |
| B10 | 30 | 720 | 24 | 50 | 720 | 16 | 193.4 | 331.0 | 45.3 | 1.43 | 93 | |
| B11 | 20 | 710 | 24 | 50 | 750 | 16 | 197.7 | 334.6 | 46.8 | 0.71 | 65 | Comparative |
| B12 | 10 | 680 | 24 | 50 | 670 | 0.5 | 244.4 | 405.8 | 34.2 | 1.45 | 87 | |
| B13 | 25 | 710 | 24 | 60 | 540 | 12 | 320.2 | 487.4 | 32.6 | 1.48 | 80 | |
| B14 | 20 | 710 | 24 | 5 | 700 | 12 | 187.2 | 325.5 | 47.5 | 0.84 | 65 | |
| B15 | 10 | 700 | 24 | 50 | 670 | 2 | 227.4 | 378.0 | 40.1 | 1.01 | 87 | Present |
| B16 | 20 | 710 | 24 | 50 | 670 | 8 | 204.6 | 346.4 | 42.3 | 1.23 | 91 | Invention |
| B17 | 25 | 715 | 24 | 50 | 670 | 24 | 191.4 | 326.0 | 48.9 | 1.52 | 92 | |

TABLE 11

| Run | Chemical Composition (wt %, bal: Fe) | | | | | | | | | | $Ac_1$ | |
|---|---|---|---|---|---|---|---|---|---|---|---|---|
| No. | C | Si | Mn | P | S | sol.Al | Ni | B | Ca | N | (°C.) | Remarks |
| C1 | 0.12 | 0.05 | 0.13 | 0.011 | 0.004 | 0.17 | Tr | 0.0027 | 0.004 | 0.0028 | 723.0 | x |
| C2 | 0.23 | 0.26 | 0.15 | 0.009 | 0.003 | 0.19 | Tr | 0.0020 | 0.003 | 0.0041 | 728.9 | |
| C3 | 0.38 | 0.87 | 0.13 | 0.011 | 0.004 | 0.17 | Tr | 0.0027 | 0.004 | 0.0045 | 746.9 | |
| C4 | 0.54 | 2.16 | 0.14 | 0.010 | 0.003 | 0.18 | Tr | 0.0024 | 0.003 | 0.0042 | 784.3 | x |

x: Outside the range of the Present Invention.

TABLE 12

| Run No. | YP ($N/mm^2$) | TS ($N/mm^2$) | El (%) | Graphitization (%) | Impact Value of Weld Zone (kgf-m), 0° C. | Hardness After Heat Treatment (HRC) | Remarks |
|---|---|---|---|---|---|---|---|
| C1 | 270.0 | 426.0 | 35.1 | 25 | 7.2 | 34.1 | x |
| C2 | 195.0 | 345.0 | 43.3 | 95 | 5.6 | 42.3 | |
| C3 | 179.0 | 343.3 | 43.5 | 95 | 3.8 | 52.9 | |
| C4 | 161.0 | 344.0 | 43.4 | 100 | 0.8 | 60.1 | x |

x: Outside the range of the Present Invention.

EXAMPLE 8

Cold-rolled steel plates having the steel compositions shown in Table 13 were manufactured under the conditions indicated below.

i) Hot rolling:

Heating before hot rolling: 1200° C.×1 hour

Finishing Temperature: 900° C.

Finishing Thickness: 2.5 mm (starting slab thickness of 220 mm)

ii) Cooling and coiling after hot rolling:

Hot-rolled plates were cooled at a cooling rate of 25° C./sec to 550° C. and coiled.

iii) Annealing of hot-rolled steel plate:

Hot-rolled steel plates were annealed at 700° C. for 25 hours.

iv) Cold rolling:

Cold rolling in a single pass was carried out with a reduction of 60%.

v) Annealing of cold-rolled steel plate:

Box annealing was carried out by heating 680° C. for 24 hours.

Mechanical properties, graphitizations, hardnesses after heat treatment, and impact values of the weld zones of the resulting cold-rolled steel plates were determined as in Examples 1 and 3. Test results are shown in Table 14.

As shown in Table 14, according to this invention, steel plates other than those of a high-Si steel exhibited a high graphitization of 70% or higher, a high strength of the order of 300 $N/mm^2$, an elongation of 40% or more, and an r-value of 1.2 or larger. The hardness after heat treatment was 40 HRC or larger. This means that according to this invention a high strength final product can be manufactured through heat treatment.

Furthermore, the impact value of the weld zone was 5 $kgf\text{-}m/cm^2$ or larger for all cases. This means that weldability can be improved remarkably.

TABLE 13

| Run | Chemical Composition (wt %, bal: Fe) | | | | | | | | | | $Ac_1$ |
|---|---|---|---|---|---|---|---|---|---|---|---|
| No. | C | Si | Mn | P | S | sol.Al | Ni | B | Ca | N | (°C.) |
| D1 | 0.39 | 0.26 | 0.19 | 0.009 | 0.005 | 0.26 | Tr | 0.0020 | 0.003 | 0.0041 | 730.5 |
| D2 | 0.34 | 1.85 | 0.21 | 0.011 | 0.006 | 0.30 | Tr | 0.0027 | 0.004 | 0.0045 | 776.8 |
| D3 | 0.30 | 0.25 | 0.12 | 0.008 | 0.004 | 0.24 | Tr | 0.0024 | 0.003 | 0.0042 | 730.1 |
| D4 | 0.33 | 0.27 | 0.46 | 0.010 | 0.005 | 0.28 | Tr | 0.0020 | 0.004 | 0.0041 | 730.8 |
| D5 | 0.31 | 0.26 | 0.19 | 0.014 | 0.008 | 0.26 | Tr | 0.0027 | 0.003 | 0.0045 | 730.5 |
| D6 | 0.37 | 0.31 | 0.24 | 0.013 | 0.007 | 0.08 | Tr | 0.0024 | 0.002 | 0.0042 | 731.9 |
| D7 | 0.33 | 0.27 | 0.20 | 0.010 | 0.005 | 0.87 | Tr | 0.0020 | 0.003 | 0.0041 | 730.8 |
| D8 | 0.28 | 0.24 | 0.13 | 0.008 | 0.004 | 0.22 | 0.36 | 0.0027 | 0.003 | 0.0045 | 725.9 |
| D9 | 0.30 | 0.25 | 0.17 | 0.008 | 0.004 | 0.24 | 0.39 | 0.0024 | 0.003 | 0.0042 | 725.9 |
| D10 | 0.33 | 0.27 | 0.20 | 0.010 | 0.005 | 0.28 | 0.46 | 0.0020 | 0.002 | 0.0041 | 725.9 |
| D11 | 0.34 | 0.28 | 0.21 | 0.011 | 0.006 | 0.30 | 0.49 | 0.0027 | Tr | 0.0045 | 725.9 |
| D12 | 0.37 | 0.31 | 0.24 | 0.013 | 0.007 | 0.34 | 0.56 | 0.0024 | Tr | 0.0042 | 725.9 |
| D13 | 0.33 | 0.27 | 0.20 | 0.010 | 0.005 | 0.28 | 0.46 | 0.0020 | Tr | 0.0041 | 725.9 |
| D14 | 0.35 | 0.29 | 0.23 | 0.012 | 0.006 | 0.32 | 0.53 | 0.0027 | Tr | 0.0045 | 725.9 |
| D15 | 0.27 | 0.22 | 0.15 | 0.007 | 0.003 | 0.20 | 0.33 | 0.0024 | Tr | 0.0042 | 726.0 |

TABLE 14

| Run No. | Reduction in thickness (%) | Annealing Temp. (°C.) | YP (N/mm²) | TS (N/mm²) | El (%) | r-Value | Graphitization (%) | Impact Value of Weld Zone (kgf-m), 0° C. | Hardness After Heat Treatment (HRC) |
|---|---|---|---|---|---|---|---|---|---|
| D1 | 55 | 680 | 224.5 | 370.9 | 40.5 | 1.60 | 82 | 5.1 | 51.7 |
| D2 | 65 | 690 | 238.5 | 434.6 | 36.0 | 1.76 | 88 | 6.0 | 49.2 |
| D3 | 50 | 675 | 199.2 | 373.5 | 40.0 | 1.29 | 69 | 6.9 | 46.8 |
| D4 | 60 | 685 | 156.2 | 312.9 | 51.0 | 1.87 | 98 | 6.3 | 49.2 |
| D5 | 55 | 680 | 174.9 | 327.9 | 45.5 | 1.60 | 82 | 6.6 | 46.8 |
| D6 | 75 | 700 | 171.5 | 321.5 | 46.4 | 1.92 | 93 | 5.4 | 49.9 |
| D7 | 60 | 685 | 174.0 | 326.3 | 45.8 | 1.68 | 85 | 6.3 | 48.7 |
| D8 | 45 | 670 | 176.6 | 331.1 | 45.1 | 1.45 | 77 | 7.1 | 43.9 |
| D9 | 50 | 675 | 175.7 | 329.5 | 45.3 | 1.53 | 90 | 6.9 | 47.8 |
| D10 | 60 | 685 | 174.0 | 326.3 | 45.8 | 1.68 | 85 | 6.3 | 50.9 |
| D11 | 15 | 690 | 173.1 | 324.6 | 46.0 | 1.47 | 88 | 6.0 | 51.8 |
| D12 | 80 | 700 | 171.5 | 321.5 | 46.4 | 1.83 | 93 | 5.4 | 51.8 |
| D13 | 60 | 620 | 174.0 | 326.3 | 45.8 | 1.66 | 85 | 6.3 | 49.8 |
| D14 | 70 | 695 | 172.3 | 323.0 | 45.9 | 1.84 | 90 | 5.7 | 50.1 |
| D15 | 40 | 665 | 177.4 | 332.7 | 44.6 | 1.37 | 74 | 7.4 | 46.2 |

EXAMPLE 9

Hot-rolled steel plates having the steel compositions shown in Table 15 were cold rolled with a reduction in thickness of 50% to produce cold-rolled steel plates having a thickness of 3.0 mm. The cold-rolled steel plates were then subjected to graphitizing annealing at 690° C. for 24 hours using a box annealing apparatus. The graphitization and mechanical properties of the resulting annealed steel plates were determined. Test results are shown in Table 16.

Furthermore, the influence of the hydrogen content of an annealing atmosphere on the formation of graphite stains was determined using a steel plate of Steel No. 3 of Table 16 such that the content of hydrogen of the atmosphere was varied from 0% to 100 vol % to change the number of precipitated graphite stains on the surface of the plate. From the thus-obtained steel plates, cup-shaped specimens were made by drawing.

Figure 2:
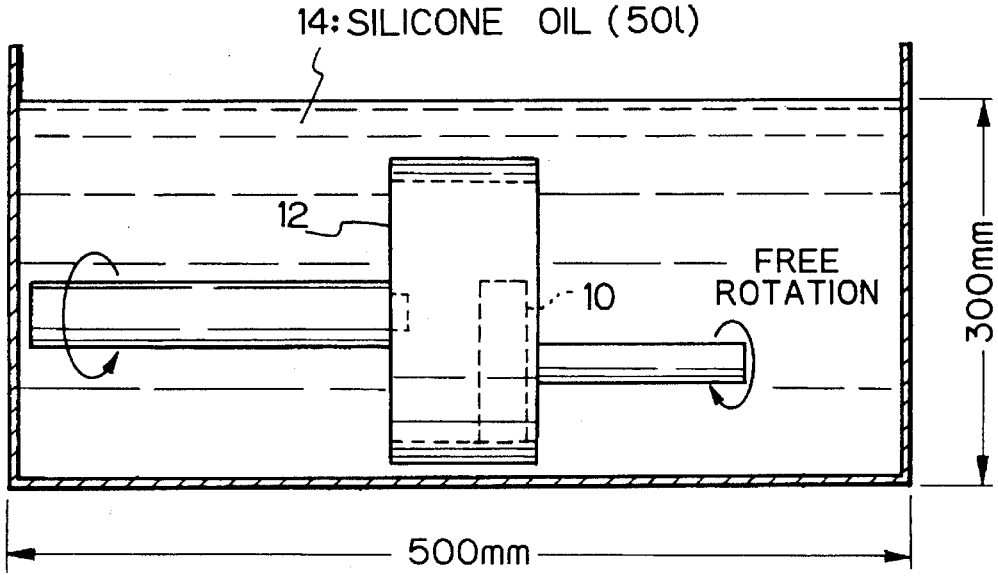
FIG. 2 is an illustration of the rotating friction test.

FIG. 1 illustrates the cup-shaped specimen together with a roller which is used in a rotating friction test. FIG. 2 is a diagrammatic view illustrating how to carry out the rotating friction test, in which a roll 10 was placed in contact with the inner surface of the cup-shaped specimen 12. The roll was cut from S15C steel rod and had a surface hardness of 300 Hv. Within a bath 14 containing 50 liters of a silicone oil, the cup-shaped specimen 12 was rotated at 3000 rpm for 100 hours with the roller 10 being freely rotated so as to carry out a simulated running test.

Figure 3:
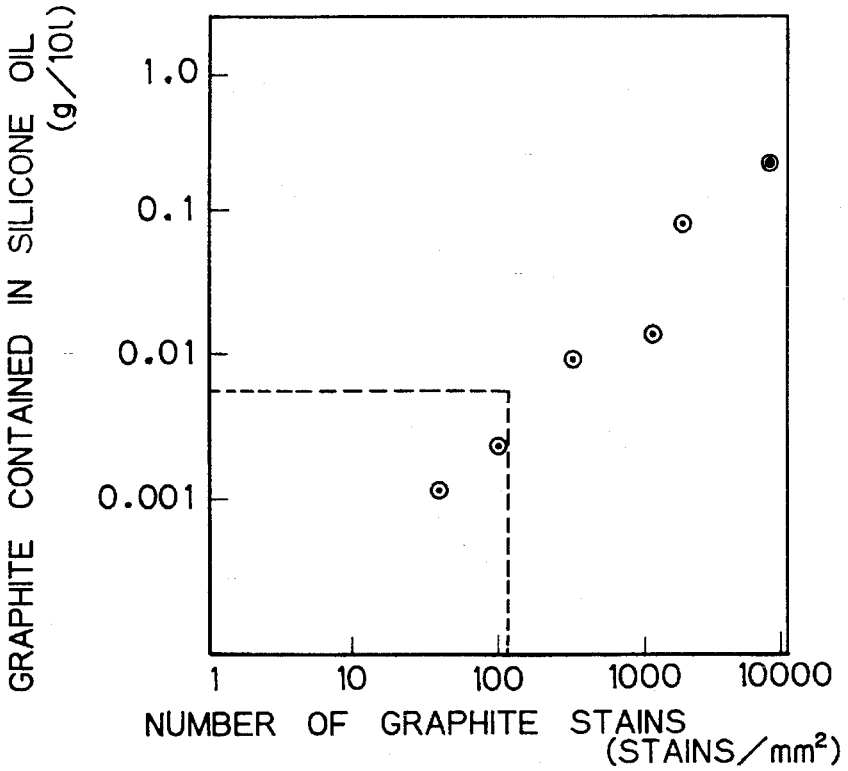
FIG. 3 is a graph showing the relationship between the number of graphite stains precipitated on the plate surface and the contamination of silicone oil by the graphite.

FIG. 3 is a graph illustrating the test results and showing the relationship between the number of graphite stains (number of stains/mm²) on the inner surface of the specimen and the content of graphite peeled off the surface into the oil during rotation (g/10 liters of silicone oil). The number of graphite stains was determined by counting the number of stains on an SEM image (×500) and converting it into the number per mm².

As is apparent from FIG. 3, in order to suppress the contamination of oil with graphite stains within the allowed maximum of 0.002 g/10 liters, it is necessary to keep the number of stains to 100 stains/mm² or smaller.

Figure 4:
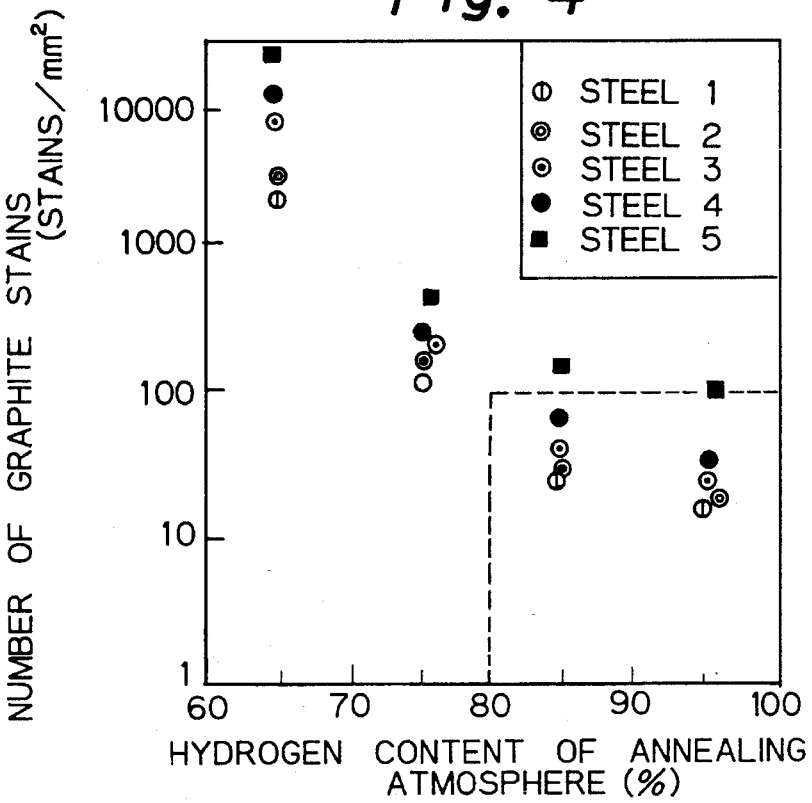
FIG. 4 is a graph showing the relationship between the number of graphite stains on the plate surface and the concentration of hydrogen gas in the annealing atmosphere.

FIG. 4 is a graph showing the relationship between the hydrogen content of the annealing atmosphere and the number of graphite stains precipitated on the plate surface.

As is apparent from FIG. 4, in this invention, in order to suppress the formation of graphite stains to within the limit of 100 stains/mm², it is necessary to restrict the hydrogen content of the annealing atmosphere to 80 vol % or higher. It is to be noted that when the carbon content of the steel plate was larger than 0.70%, it was impossible to suppress precipitation of graphite stains within the above-mentioned limit even if the hydrogen content of the annealing atmosphere was increased to 80% or more.

TABLE 15

| Run | Chemical Composition (wt %, bal: Fe) | | | | | | | | | | |
|---|---|---|---|---|---|---|---|---|---|---|---|
| No. | C | Si | Mn | P | S | Ni | Cu | sol.Al | N | Ca | B |
| 1 | 0.24 | 0.34 | 0.24 | 0.013 | 0.005 | 0.24 | 0.26 | 0.067 | 0.0058 | 0.0039 | 0.0016 |
| 2 | 0.46 | 0.31 | 0.21 | 0.013 | 0.006 | 0.20 | 0.28 | 0.060 | 0.0052 | 0.0043 | 0.0013 |
| 3 | 0.54 | 0.29 | 0.19 | 0.013 | 0.004 | 0.18 | 0.30 | 0.055 | 0.0049 | 0.0046 | 0.0010 |
| 4 | 0.68 | 0.32 | 0.22 | 0.013 | 0.006 | 0.21 | 0.28 | 0.062 | 0.0054 | 0.0041 | 0.0014 |
| 5 | 0.89* | 0.34 | 0.24 | 0.013 | 0.010 | 0.24 | 0.26 | 0.067 | 0.0058 | 0.0039 | 0.0016 |

Note: *Outside the range of the present invention.

TABLE 16

| Run No. | Graphitization (%) | YP (N/mm²) | TS (N/mm²) | El (%) |
|---|---|---|---|---|
| 1 | 50 | 210 | 320 | 42.2 |
| 2 | 70 | 223 | 335 | 44.0 |
| 3 | 85 | 237 | 326 | 43.6 |
| 4 | 90 | 205 | 324 | 42.3 |
| 5 | 85 | 194 | 321 | 44.3 |

EXAMPLE 10

Hot-rolled steel plates (4.5 mm thick) having the steel compositions shown in Table 17 were cold rolled with a reduction in thickness of 55.5% to produce cold-rolled steel plates having a thickness of 2.0 mm. The cold-rolled steel plates were then subjected to graphitizing annealing at 690° C. for 24 hours using a box annealing apparatus in which the hydrogen content of the annealing atmosphere was varied as shown in Table 18.

The graphitization, mechanical properties, and r-values in the L direction of the resulting annealed steel plates were determined. Furthermore, drawing tests were carried out with a drawing ratio of 2.0 to form a cup having a diameter of 120 mm to determine whether or not cracking occurred. Hardness was also determined for shaped products after carrying out induction hardening by heating the products at 950° C. for 30 seconds at 150 kHz and then water quenching.

Test results are shown in Table 18.

EXAMPLE 11

Hot-rolled steel plates (3.5 mm thick) having the steel composition of Steel No. 1 of Table 15 were further processed under the conditions shown in Table 19. For the resulting cold-rolled steel plates after annealing in an atmosphere containing hydrogen, the graphitization, mechanical properties, r-values in the L-direction, and hardness after heat treatment were determined in the same manner as in Example 10.

Test results are shown in Table 20.

TABLE 17

| Run | Chemical Composition (wt %, bal: Fe) | | | | | | | | | | |
|---|---|---|---|---|---|---|---|---|---|---|---|
| No. | C | Si | Mn | P | S | Ni | Cu | sol.Al | N | Ca | B |
| 1 | 0.14* | 0.24 | 0.16 | 0.010 | 0.008 | Tr | Tr | 0.067 | 0.0078 | Tr | 0.0016 |
| 2 | 0.21 | 0.22 | 0.17 | 0.011 | 0.007 | Tr | Tr | 0.062 | 0.0064 | Tr | 0.0014 |
| 3 | 0.76* | 0.25 | 0.16 | 0.009 | 0.008 | Tr | Tr | 0.069 | 0.0080 | Tr | 0.0018 |
| 4 | 0.30 | 0.09 | 0.18 | 0.012 | 0.005 | Tr | 0.31 | 0.057 | 0.0025 | Tr | 0.0011 |
| 5 | 0.28 | 1.23* | 0.19 | 0.013 | 0.006 | Tr | Tr | 0.052 | 0.0067 | Tr | 0.0009 |
| 6 | 0.36 | 0.26 | 0.12 | 0.009 | 0.008 | Tr | Tr | 0.071 | 0.0082 | Tr | 0.0019 |
| 7 | 0.32 | 0.22 | 0.78* | 0.011 | 0.005 | Tr | Tr | 0.062 | 0.0074 | Tr | 0.0014 |
| 8 | 0.34 | 0.24 | 0.16 | 0.024* | 0.016* | Tr | Tr | 0.067 | 0.0078 | Tr | 0.0016 |
| 9 | 0.35 | 0.25 | 0.16 | 0.009 | 0.003 | 2.11* | 0.25 | 0.069 | 0.0080 | 0.0037 | 0.0018 |
| 10 | 0.32 | 0.22 | 0.17 | 0.011 | 0.003 | 0.21 | 1.31* | 0.062 | 0.0074 | 0.0041 | 0.0014 |
| 11 | 0.34 | 0.24 | 0.16 | 0.010 | 0.006 | 0.24 | 0.26 | 0.032 | 0.0078 | Tr | 0.0016 |
| 12 | 0.32 | 0.22 | 0.17 | 0.011 | 0.004 | 0.21 | Tr | 0.062 | 0.0013* | 0.0041 | 0.0014 |
| 13 | 0.34 | 0.24 | 0.16 | 0.010 | 0.007 | Tr | 0.26 | 0.067 | 0.0076 | 0.0039 | 0.0016 |
| 14 | 0.35 | 0.25 | 0.16 | 0.009 | 0.006 | 0.25 | 0.25 | 0.069 | 0.0134* | 0.0037 | 0.0018 |
| 15 | 0.28 | 0.18 | 0.19 | 0.013 | 0.003 | 0.16 | 0.31 | 0.052 | 0.0067 | 0.0047 | Tr* |
| 16 | 0.35 | 0.25 | 0.16 | 0.009 | 0.006 | 0.25 | 0.25 | 0.069 | 0.0080 | 0.0039 | 0.0053* |

Note: *Outside the range of the present invention.

TABLE 18

| Run No. | Graphitization (%) | YP ($N/mm^2$) | TS ($N/mm^2$) | El (%) | r-Value | Cracks during drawing | Hydrogen in Atmosphere (%) | Precipitation of graphite ($stains/mm^2$) | Hardness After Induction Hardening (Hv) |
|---|---|---|---|---|---|---|---|---|---|
| 1 | 20 | 217 | 350 | 41.7 | 1.06 | o | 89 | 20 | 240 |
| 2 | 50 | 210 | 350 | 42.2 | 1.12 | o | 85 | 40 | 355 |
| 3 | 85 | 237 | 376 | 38.6 | 0.92 | x | 91 | 800 | 630 |
| 4 | 65 | 205 | 354 | 42.3 | 1.02 | o | 81 | 80 | 401 |
| 5 | 100 | 218 | 389 | 39.1 | 1.01 | x | 87 | 80 | 390 |
| 6 | 85 | 215 | 336 | 42.8 | 1.06 | o | 93 | 20 | 432 |
| 7 | 15 | 263 | 438 | 33.8 | 0.86 | x | 85 | 60 | 411 |
| 8 | 30 | 254 | 410 | 35.6 | 0.89 | x | 89 | 40 | 422 |
| 9 | 100 | 241 | 382 | 38.0 | 0.96 | x | 91 | 40 | 427 |
| 10 | 85 | 218 | 364 | 40.7 | 1.01 | x | 85 | 80 | 411 |
| 11 | 90 | 206 | 332 | 44.0 | 1.12 | o | 89 | 60 | 422 |
| 12 | 30 | 343 | 480 | 31.2 | 0.96 | x | 85 | 10 | 411 |
| 13 | 85 | 207 | 334 | 43.7 | 1.16 | o | 89 | 40 | 422 |
| 14 | 90 | 322 | 443 | 36.1 | 0.86 | x | 91 | 40 | 427 |
| 15 | 95 | 195 | 320 | 45.9 | 1.16 | x | 87 | 80 | 417 |
| 16 | 45 | 350 | 421 | 36.0 | 0.89 | x | 91 | 20 | 427 |

Note:
Hot-rolled plate: 4.5 mm thick, Cold-rolled plate: 2.0 mm thick (Reduction 55.5%).
Box Annealing at 690° C.
Occurrence of cracking during drawing under conditions of an outer diameter of 120 mm, draw ratio of 2.0, x: cracks occurred, o: No cracking
Surface hardness after heating at 950° C. × 30 sec. at 150 KHz and water-quenching.

As is apparent from Table 20, when the annealing temperature was higher than that required in this invention the degradation in graphitization and formability was inevitable. Furthermore, when the reduction in cold rolling was high, breakage of the steel plate during cold rolling occurred. When the annealing temperature was rather low within the range of this invention, the graphitization was somewhat lower, and small cracks were found on the periphery of the bottom surface of a drawn product.

TABLE 19

| | Annealing After Hot Rolling | | Reduction in Thickness during | Annealing after Preliminary Cold rolling | | Reduction in Thickness during | Annealing after Secondary Cold rolling | |
|---|---|---|---|---|---|---|---|---|
| Run No. | Hydrogen in Atmosphere (%) | Soaking | Preliminary Cold Rolling (%) | Hydrogen in Atmosphere (%) | Soaking | Secondary Cold Rolling (%) | Hydrogen in Atmosphere (%) | Soaking |
| 1 | 100 | 680° C. × 24 h | — | — | — | — | — | — |
| 2 | " | 720° C. × 24 h | — | — | — | — | — | — |
| 3 | " | 760° C. × 24 h | — | — | — | — | — | — |
| 4 | — | — | 30 | 100 | 680° C. × 24 h | — | — | — |
| 5 | — | — | 75 | " | 720° C. × 24 h | — | — | — |
| 6 | — | — | 95 | " | 760° C. × 24 h | — | — | — |
| 7 | 100 | 680° C. × 24 h | 30 | " | 680° C. × 24 h | — | — | — |
| 8 | " | 720° C. × 24 h | 75 | " | 720° C. × 24 h | — | — | — |
| 9 | " | 760° C. × 24 h | 95 | " | 760° C. × 24 h | — | — | — |
| 10 | — | — | 30 | " | 680° C. × 24 h | 30 | 100 | 680° C. × 24 h |
| 11 | — | — | 75 | " | 720° C. × 24 h | 75 | " | 720° C. × 24 h |
| 12 | — | — | 75 | " | 760° C. × 24 h | 75 | " | 760° C. × 24 h |
| 13 | 100 | 680° C. × 24 h | 30 | " | 680° C. × 24 h | 30 | " | 680° C. × 24 h |
| 14 | " | 720° C. × 24 h | 75 | " | 720° C. × 24 h | 75 | " | 720° C. × 24 h |
| 15 | " | 760° C. × 24 h | 75 | " | 760° C. × 24 h | 75 | " | 760° C. × 24 h |

Note: Thickness of hot-rolled plate = 3.5 mm

TABLE 20

| Run No. | Graphitization (%) | YP ($N/mm^2$) | TS ($N/mm^2$) | El (%) | r-Value | Cracks during drawing | Precipitation of graphite ($stains/mm^2$) | Hardness After Induction Hardening (Hv) |
|---|---|---|---|---|---|---|---|---|
| 1 | 55 | 294 | 386 | 40.3 | 0.84 | Δ | 60 | 315 |
| 2 | 65 | 265 | 356 | 42.3 | 0.89 | o | 80 | 312 |
| 3 | 0 | 367 | 470 | 31.2 | 0.78 | x | 60 | 324 |
| 4 | 65 | 223 | 337 | 44.5 | 0.89 | o | 40 | 312 |
| 5 | 85 | 189 | 334 | 44.9 | 0.95 | o | 40 | 310 |
| 6 | | | | | | | | |
| 7 | 75 | 189 | 325 | 46.7 | 1.02 | o | 80 | 313 |
| 8 | 85 | 178 | 320 | 48.7 | 1.16 | o | 80 | 309 |
| 9 | | | | | | | | |
| 10 | 85 | 178 | 321 | 47.3 | 1.32 | o | 80 | 313 |
| 11 | 90 | 195 | 318 | 48.7 | 1.42 | o | 80 | 311 |
| 12 | 10 | 332 | 435 | 32.4 | 0.86 | x | 80 | 319 |
| 13 | 90 | 182 | 312 | 50.7 | 1.39 | o | 80 | 313 |
| 14 | 95 | 199 | 308 | 51.2 | 1.46 | o | 80 | 306 |
| 15 | 10 | 322 | 398 | 34.6 | 0.92 | x | 80 | 327 |

Note: Occurrence of cracking during drawing under conditions of an outer diameter of 120 mm, draw ratio of 2.0, x: cracks occurred, o: No cracking
Surface hardness after heating at 950° C. × 30 sec. at 150 KHz and water-quenching.

What is claimed is:

1. A process for manufacturing a medium-carbon steel plate having a graphitization of 50% or more with improved formability and weldability, which comprises the steps of:

hot rolling a steel with a finishing temperature of 700°–900° C., the steel consisting essentially of, by weight %:

C: 0.20–0.70%,

Si: more than 0.20 but not more than 2.00%,

Mn: 0.05–0.50%, P: not more than 0.020%,

S: not more than 0.010%, sol. Al: 0.01–1.00%,

B: 0.0003–0.0050%, N: 0.002–0.010%,

B/N: 0.2–0.8,

Cu: 0–1.00%, Ni: 0–2.00%, Ca: 0–0.010%, and

Fe and incidental impurities: balance, cooling the resulting hot-rolled steel plate at a cooling rate of 5°–50° C./s, coiling the steel plate at a temperature of 400°–650° C., cold rolling the hot-rolled steel plate with a reduction in thickness of 20–85%, and annealing the cold-rolled steel plate at a temperature of 600°- $Ac_1$ for 1 hour or longer.

2. A process for manufacturing a medium-carbon steel plate as set forth in claim 1 wherein before carrying out the cold rolling a preliminary annealing is applied to the hot-rolled steel plate at a temperature of 600°- $Ac_1$ for 6 hours or longer.

3. A process for manufacturing a medium-carbon steel plate as set forth in claim 1 wherein the annealing temperature is 670°–740° C.

4. A process for manufacturing a medium-carbon steel plate as set forth in claim 1 wherein at least the annealing is carried out in an atmosphere containing 80% or more of hydrogen.

5. A process for manufacturing a medium-carbon steel plate as set forth in claim 1 in which

C: 0.20–0.40%.

6. A process for manufacturing a medium-carbon steel plate as set forth in claim 1 in which Si: more than 0.20% but not more than 1.00%.

7. A process for manufacturing a medium-carbon steel plate as set forth in claim 1 in which sol. Al: 0.05–1.00%.

8. A process for manufacturing a medium-carbon steel plate as set forth in claim 1 in which Cu: 0.05–1.00%.

9. A process for manufacturing a medium-carbon steel plate as set forth in claim 1 in which Ni: 0.05–2.00%.

10. A process for manufacturing a medium-carbon steel plate as set forth in claim 1 in which Ca: 0.001–0.010%.

11. A process for manufacturing a medium-carbon steel plate as set forth in claim 1, the steel including at least 0.26% Si and the annealing step effecting graphitization of 50% or more of cementite in the steel plate.

12. A process for manufacturing a medium-carbon steel plate as set forth in claim 1, the steel having B/N: 0.34 - 0.8 and the annealing step effecting graphitization of 50% to 90% of cementite in the steel plate.

* * * * *